United States Patent [19]

Prosise et al.

[11] Patent Number: 5,049,710

[45] Date of Patent: Sep. 17, 1991

[54] MICROWAVE FOOD CARTON HAVING TWO INTEGRAL LAYER-DIVIDER PANELS AND BLANK THEREFOR

[75] Inventors: Robert L. Prosise; Paul R. Bunke, both of Cincinnati, Ohio

[73] Assignee: The Procter & Gamble Company, Cincinnati, Ohio

[21] Appl. No.: 458,934

[22] Filed: Dec. 29, 1989

[51] Int. Cl.[5] ..... H05B 6/80

[52] U.S. Cl. ..... 219/10.55 E; 219/10.55 F; 426/107; 426/234; 206/45.19; 229/120.21; 229/120.32; 229/903

[58] Field of Search ..... 219/10.55 E, 10.55 F; 99/DIG. 14; 426/107, 113, 114, 115, 118, 119, 234, 243; 206/45.14, 45.19; 229/120.21, 120.32, 903, 904, 906

[56] References Cited

U.S. PATENT DOCUMENTS

| | | | |
|---|---|---|---|
| 1,685,798 | 10/1928 | Armstrong | 229/120.21 |
| 2,850,224 | 9/1958 | Meinhardt et al. | 229/120.21 |
| 2,948,455 | 8/1960 | Frankenstein | 229/120.21 |
| 4,190,757 | 2/1980 | Turpin et al. | 219/10.55 E |
| 4,230,924 | 10/1980 | Brastad et al. | 219/10.55 E |
| 4,267,420 | 5/1981 | Brastad | 219/10.55 E |
| 4,498,420 | 2/1985 | Botterman et al. | 229/120.21 |
| 4,517,206 | 5/1985 | Murphy et al. | 426/119 |
| 4,590,080 | 5/1986 | Pinegar | 426/441 |
| 4,590,349 | 5/1986 | Brown et al. | 219/10.55 E |
| 4,594,492 | 6/1986 | Maroszek | 219/10.55 E |
| 4,641,005 | 2/1987 | Seiferth | 219/10.55 E |
| 4,777,053 | 10/1988 | Tobelmann et al. | 426/107 |
| 4,825,025 | 4/1989 | Seiferth | 219/10.55 E |
| 4,836,383 | 6/1989 | Gordon et al. | 206/611 |
| 4,864,089 | 9/1989 | Tighe et al. | 219/10.55 E |
| 4,943,439 | 7/1990 | Andreas et al. | 426/107 |
| 4,944,452 | 7/1990 | Kent et al. | 229/120.21 |

OTHER PUBLICATIONS

Microwave Susceptor Use Continues to be Hot Topic by Stanley Sacharow/Packaging Group Paper, Film & Foil Converter, Jan. 1989.

*Primary Examiner*—Philip H. Leung

*Attorney, Agent, or Firm*—Michael E. Hilton; John V. Gorman; Richard C. Witte

[57] ABSTRACT

A microwave food carton having two integral layer-divider panels, and a one piece blank which may be erected to form the carton. Surface areas of the top and bottom walls of the carton, and the integral layer-divider panels, are each provided with a layer of microwave susceptor material so that they are directly heated thereby upon application of microwave energy. Such a carton is particularly useful in a microwave food package for microwave heating oppositely facing surfaces of each of a plurality of food pieces disposed in three layers in the package. In such a package, one of the integral layer-divider panels is disposed between each two adjacent layers of food pieces; the food pieces are preferably uniformly thick and have planar upper and lower surfaces; and the carton is preferably sized, relative to the sizes of the food pieces, to ensure a snug contacting relation between the microwave susceptor covered walls and panels of the carton, and the planar surfaces of each of the food pieces. An exemplary use of the carton is to package potato strips which are preferably parfried prior to packaging; and which, upon being microwaved for a sufficient period of time, become crispened on their outsides; and provide a crisp-exterior, meaty-interior eating sensation without having to be deep fried.

5 Claims, 7 Drawing Sheets

MICROWAVE FOOD CARTON HAVING TWO INTEGRAL LAYER-DIVIDER PANELS AND BLANK THEREFOR

TECHNICAL FIELD

This invention pertains, in general, to unitary cartons for microwave food packages which packages are suitable for microwave heating and crispening food pieces disposed therein by virtue of having a layer of microwave susceptor material on their top and bottom walls, and each layer-divider panel of the package. More specifically, it pertains to cartons which may be erected from one piece blanks of paperboard or cartonboard or the like, and which cartons are useful for such packages having food pieces disposed in three or more layers therein; and wherein two or more integral layer-divider panels are provided. This includes cartons for packages which are suitable for warehousing, transporting, and marketing with food product disposed therein, as well as cartons which are suitable for having food pieces placed therein at the site where the heating and crispening are to occur: e.g., in a consumer's kitchen.

BACKGROUND ART

A microwaveable food carton comprising an integral, mid-elevation food supporting panel having a sheet of microwave interactive material placed on one surface is disclosed in U.S. Pat. No. 4,836,383, Microwave Food Carton With Divider Panel which patent issued June 6, 1989 to Gordon et al. Essentially, the construction of the carton is such that food contained within the carton is elevated above the carton bottom on a false bottom: i.e., the mid-elevation food support panel. Thus, the microwave interactive material on the mid-elevation food support panel causes the support panel to have a hot plate heating effect on the food supported thereon. The function of the microwave interactive sheet is stated to be to brown or crispen the contacted surface of the food product.

A microwaveable food package and carton therefore comprising microwave susceptors (i.e., materials which are heated by internally generated heat when subjected to microwave energy) for browning and crisping two sides of food pieces contained therein is disclosed in U.S. Pat. No. 4,590,349, Microwave Cooking Carton For Browning And Crisping Food On Two Sides which patent issued May 20, 1986 to Brown et al. It is specifically directed to browning and crisping two sides of food pieces having non-uniform dimensions; the carton has an internal height exceeding the average vertical height of the food pieces; and it states that the package be inverted during the microwave heating cycle to cause the food pieces to gravitationally contact a final food support panel disposed in the top portion of the carton.

Additional U.S. Patents which disclose microwave food packages and browning of foodstuffs packaged therein include: U.S. Pat. No. 4,190,757, Microwave Heating Package and Method which issued Feb. 26, 1980 to Turpin et al; U.S. Pat. No. 4,267,420, Packaged Food Item And Method For Achieving Microwave Browning Thereof which issued May 12, 1981 to Brastad; U.S. Pat. No. 4,594,492, Microwave Package Including A Resiliently Biased Browning Layer which issued June 10, 1986 to Maroszek; and U.S. Pat. No. 4,777,053, Microwave Heating Package which issued Oct. 11, 1988 to Tobelmann et al.

Further disclosures of microwave cartons, packages, and susceptors are included in the following U.S. Pat. Nos: 4,641,005 and 4,825,025, both titled Food Receptacle For Microwave Cooking, which issued Feb. 3, 1987 and Apr. 25, 1989, respectively, to Oscar E. Seiferth; and U.S. Pat. No. 4,230,924, Method And Material For Prepackaging Food To Achieve Microwave Browning which issued Oct. 28, 1980; and U.S. Pat. No. 4,864,089, Localized Microwave Radiation Heating which issued Sept. 5, 1989 to Tighe et al. Tighe et al (4,864,089) disclose formation of microwave susceptor areas on suitable substrates by coating or printing a resin binder with conductive and semiconductive particles.

Microwave susceptor technology is discussed further in Microwave Susceptor Use Continues To Be Hot Topic, Paper, film & Foil Converter, January 1989, pages 62–64, inclusive. Additionally, parfrying technology, which is considered to be ancillary to the present invention, is disclosed in U.S. Pat. No. 4,590,080, Process For Preparing Parfried And Frozen Potato Products which issued May 20, 1986.

DISCLOSURE OF THE INVENTION

A microwave carton is provided which is formed from a one piece blank comprising a top wall, a bottom wall, side walls, end walls, glue flaps, and two layer-divider panels. The carton comprises means for being erected, filled with three layers of food pieces, and closed with one of the layer- divider panels disposed between each two adjacent layers of food pieces; and microwave susceptor means which are configured and disposed to provide portions thereof adjacent the upper and lower surfaces of each of the food pieces. The carton is preferably sized to accommodate three layers of food pieces so that upper and lower surfaces of each food piece are in snug, contacting relation with adjacent portions of the microwave susceptor means. The carton may further comprise means for maintaining such a snug contacting relationship while the package is heated in a microwave oven. Preferably, the food pieces are uniformly thick, and have oppositely facing planar surfaces to facilitate the snug contacting relationship, and thus enable direct conductive heating of those surfaces by the microwave susceptors while the package is subjected to microwave energy in a microwave oven for a sufficient period of time. The microwave susceptors are preferably configured to effect sufficient such direct heating that the food pieces give a crisp-exterior, meaty-interior eating sensation. In one aspect of the invention, the microwave susceptor means comprises a layer of microwave susceptor material on the top wall, the bottom wall, and each of the two layer-divider panels. The microwave carton may further comprise means for being substantially sealed after being filled, and means for being vented to enable volatiles from said food pieces to escape during microwave heating. In another aspect of the invention, the microwave carton may further comprise duplex opening means for enabling eating access to the food pieces through at least two walls of the carton. The top wall may be provided with means for enabling consumer eating access to the top layer of the food pieces; and the layer divider panels may be provided with means for enabling through-the-top, layer-by-layer consumer eating access to the intermediate layer and the bottom layer of the food pieces. The means for enabling consumer access may comprise lines of weakening which may be ruptured by a consumer to enable folding back or tearing off portions of the top walls and the layer-divider panels.

BRIEF DESCRIPTIONS OF THE DRAWINGS

While the specification concludes with claims which particularly point out and distinctly claim the subject matter regarded as forming the present invention, it is believed the invention will be better understood from the following description taken in conjunction with the accompanying drawings in which identical facets in the several views are identified by the same designators, and similar facets of the several embodiments are identified by designators having common tens and units digits, and in which:

DETAILED DESCRIPTION OF THE INVENTION

Figure 1:
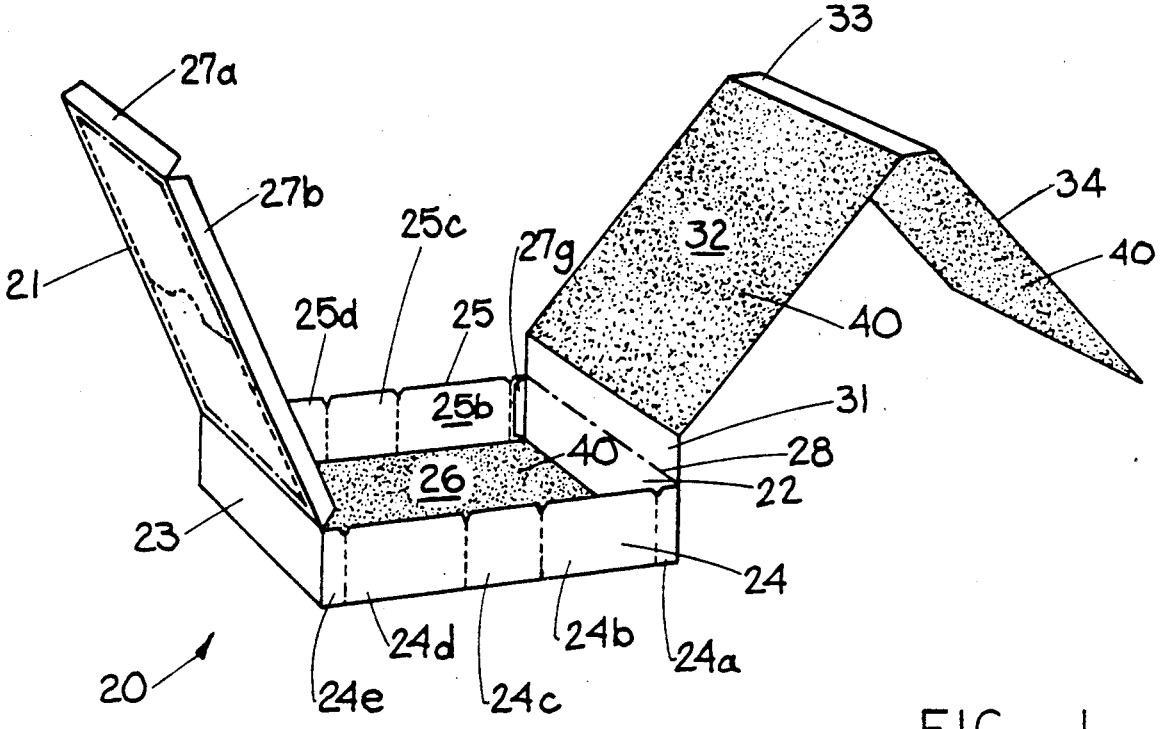
FIG. 1 is a perspective view of a carton comprising a one piece blank having two integral layer-divider panels which are each provided with a layer of microwave susceptor material, and which panels are hereinafter referred to as intermediate-elevation microwave susceptor panels.

Carton 20, an exemplary embodiment of the present invention, is shown in FIG. 1 to comprise a top wall 21, front wall 22, back wall 23, side walls 24 and 25, bottom wall 26, and glue flaps 27*a*, 27*b*, and 27*g*. Additionally, a concatenated assemblage of four panels is integrally hinged to the top edge 28 of front wall 22, which panels are: a first spacer panel 31; a lower layer-divider panel 32; a second spacer panel 33; and an upper layer-divider panel 34. The stippled areas of bottom wall 26, and layer-divider panels 32 and 34 are each provided with a layer of microwave susceptor material designated 40. The layers of microwave susceptor material may, for example, be directly applied, or may comprise microwave susceptor coated thermoplastic films which are adhesively or otherwise laminated or adhered to their respective walls or panels of the carton as disclosed in the patents discussed above. Additionally, the underside of top wall 21 is also provided with such a layer of microwave susceptor material 40 albeit it is not visible in FIG. 1.

As used herein, the terms top, bottom, sides, front, back, upper, and lower and the like are relative terms, and are not intended to connote any particular disposition for placement in a microwave oven, or for positioning the carton for opening the carton or removing contents therefrom.

Still referring to FIG. 1, it is not intended to limit the present invention to any particular susceptor material, or technique for providing layers thereof on the designated walls and panels of the carton. However, laminated susceptors which comprise a layer of thermoplastic film which has been thinly coated with vapor deposited metal (e.g., aluminum), and a layer of a strength substrate such as paper are suitable; and exemplary such laminated susceptors have been procured, for instance, from the Metalizing Division of Leigh-Mardon PTY, LTD. 9 MeLissa St., Auburn, New South Wales 2144. Also, the walls and panels which are provided with a layer of microwave susceptor material are generically referred to as microwave susceptors or microwave susceptor panels and/or walls regardless of how the microwave susceptor material is incorporated.

Briefly, carton 20 is sized and configured to hold three layers of food pieces; to have the susceptor bearing, layer-divider panels 32 and 34 disposed between the layers; and to have the upper and lower surfaces of each food piece in snug contacting relation with a microwave susceptor panel of the carton. In an exemplary microwave food package comprising three layers of square-cut, parfried potato strips disposed within a carton 20, carton 20 comprises means for heating, with microwave susceptors, at least the upper and lower surfaces of each of the potato strips to effect crispening of the exteriors of the potato strips. Such crispened potato strips are referred to herein as french fries because they provide a sensation of crisp exteriors and meaty interiors when eaten albeit they are not deep fat fried to a doneness state in the manner of traditional french fries.

Figure 2:
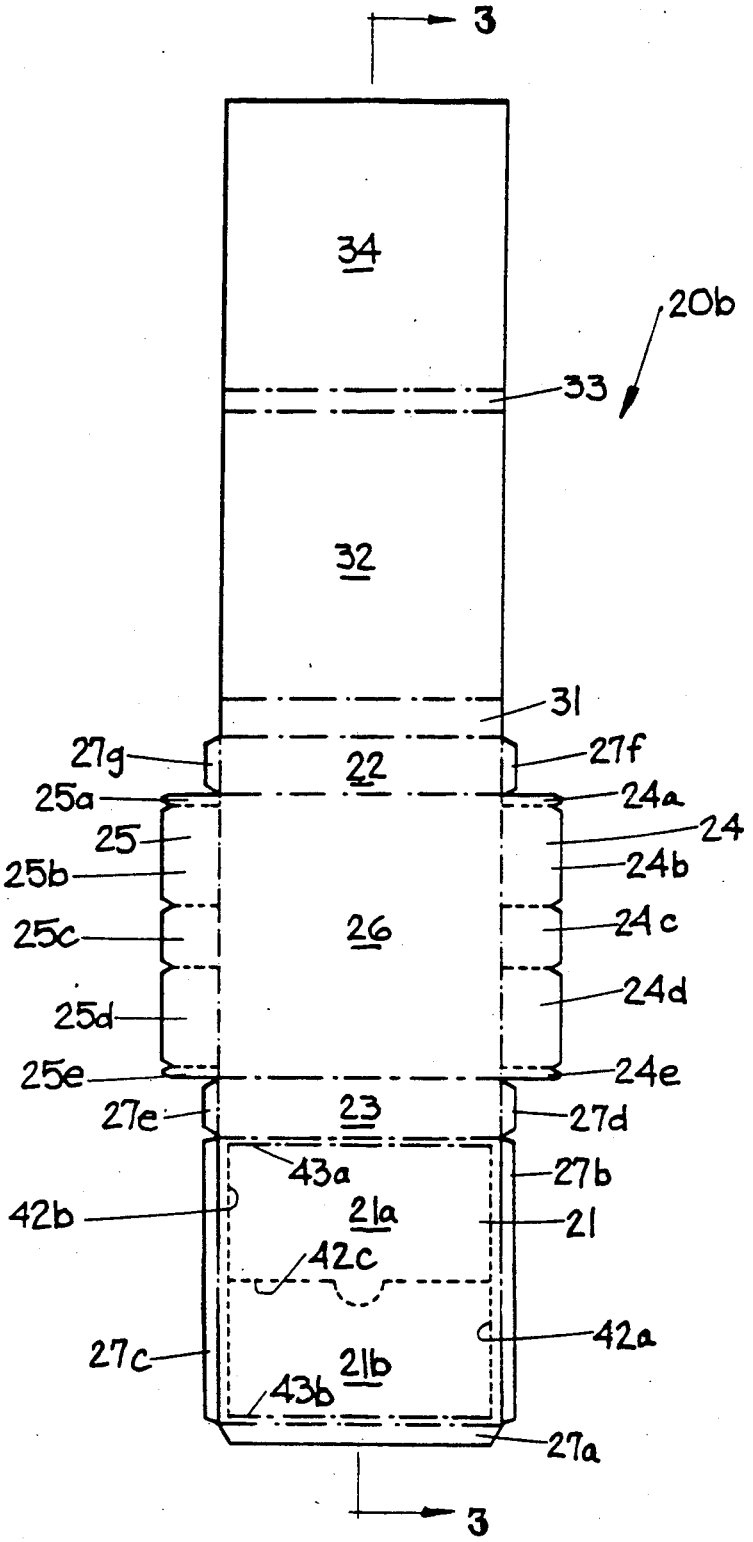
FIG. 2 is a plan view of a one piece carton blank having two integral layer-divider panels which carton blank may be erected to form a carton of the configuration shown in FIG. 1.

Referring now to FIG. 2, a one piece carton blank 20*b* is shown in plan view to comprise top wall 21, front wall 22, back wall 23, side walls 24 and 25, bottom wall 26, glue flaps 27*a* through 27*g*, first spacer panel 31, lower layer-divider panel 32, second spacer panel 33, and upper layer-divider panel 34. Top wall 21 is subdivided by lines of weakening 42*a*, 42*b* and 42*c*, and score lines 43*a* and 43*b* to define sub panels 21*a* and 21*b*. Side walls 24 and 25 are subdivided into sub panels 24*a* through 24*e*, and 25*a* through 25*e*, respectively by lines of weakening. Sub panels 24*a*, 24*e*, 25*a* and 25*e* are corner support panels; sub panels 24*b*, 24*d*, 25*b* and 25*d* are vent panels; and sub panels 24*c* and 25*c* are strap panels. When the vent panels are opened as described later, the strap panels act to maintain the original spacing between the top and bottom walls. Albeit both side walls are subdivided to provide vent means, and side access to the contents of carton 20, it is believed that only one side wall needs to be opened to enable sufficient venting and eating access.

Figure 3:
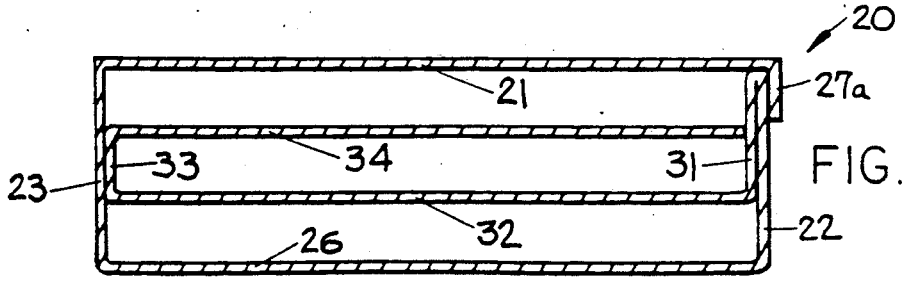
FIG. 3 is a cross sectional view of a closed carton formed by erecting and closing a carton blank of the configuration shown in FIG. 2, and which view is taken along a section line corresponding to section line 3—3 of FIG. 2.
Figure 4:
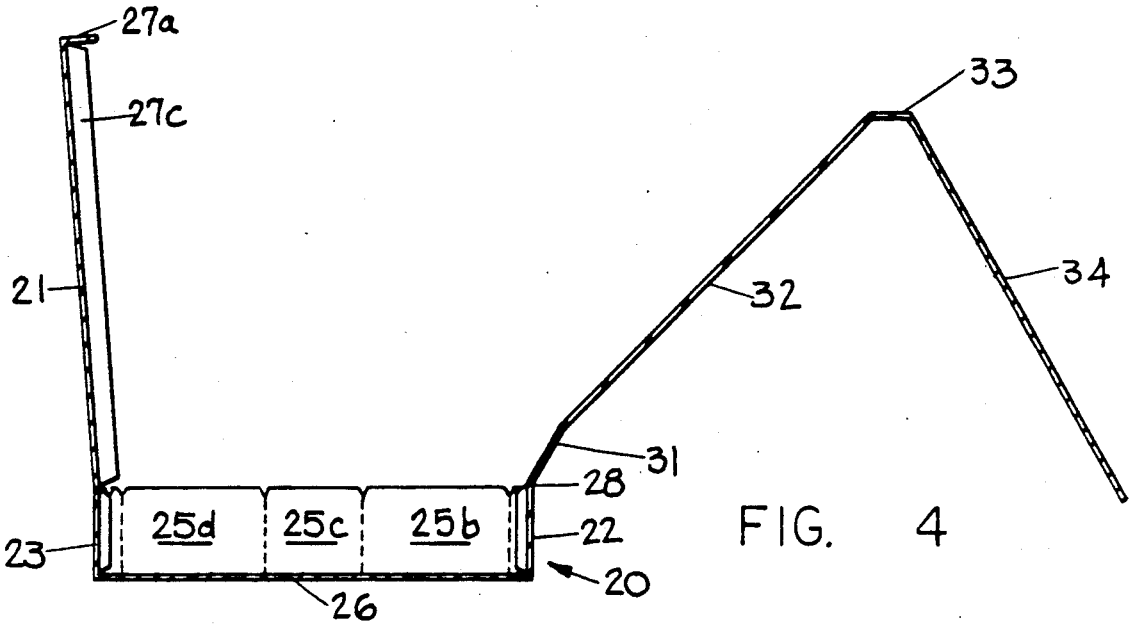
FIG. 4 is a side view of an empty carton of the configuration shown in FIG. 1, and before its intermediate-elevation microwave susceptor panels have been folded inward.
Figure 5:
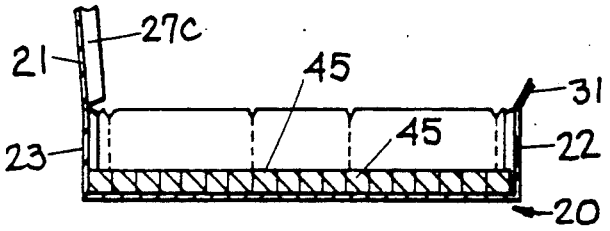
FIG. 5 is a view of the carton of FIG. 4 after one layer of food pieces has been placed therein.
Figure 6:
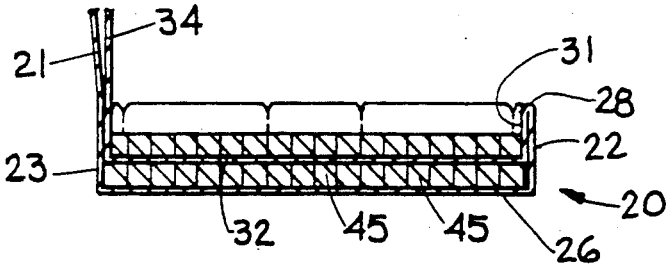
FIG. 6 is a view of the carton of FIG. 5 after a second layer of food pieces has been placed therein, and with an integral intermediate-elevation microwave susceptor panel disposed between the two layers.
Figure 7:
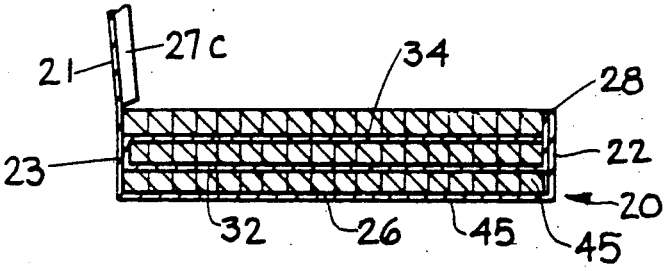
FIG. 7 is a view of the carton of FIG. 6 after it has been fully loaded with three layers of food pieces, and with its two integral, intermediate-elevation microwave susceptor panels disposed between adjacent layers of food pieces.
Figure 8:
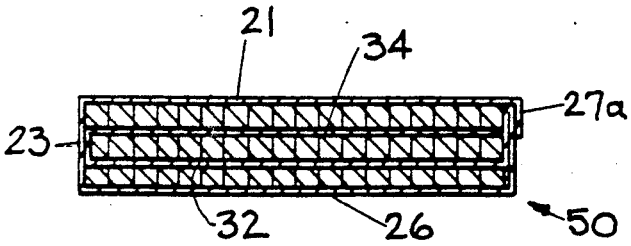
FIG. 8 is a view of the loaded carton of FIG. 7 after its top has been closed.

First spacer 31 has a height (i.e., its vertical dimension when the carton is erected, closed, and oriented as shown in FIG. 3) equal to the combined heights of two layers of articles to be packaged in a carton made from blank 20*b*; second spacer 33 has a height equal to the height of one layer of articles; and the interior height of the carton is sufficient to snugly accommodate three layers of articles plus the layer-divider panels 32 and 34. In use, strap panels 24*c* and 25*c* constitute means for maintaining this snug relation when such a package is heated in a microwave oven with one or more vent panels open.

FIG. 3 is a sectional view of a carton 20 which is formed by erecting a carton blank 20*b*, FIG. 2 and is taken along a section line corresponding to section line 3—3 indicated on FIG. 2. This view shows the relative positions of the integral layer-divider panels 32 and 34 as they would be positioned in the presence of three layers of articles as described above. However, the articles are not shown in FIG. 3 in order to more clearly show the relative positions of the panels of the carton. Also for clarity, albeit top and bottom walls 21 and 26, respectively, and at least one surface of each of the layer-divider panels 32 and 34 are provided with a layer of microwave susceptor material as described above prior to filling and closing carton 20, the layers of susceptor material are not shown in FIG. 3.

FIGS. 4 through 8 are sequential views which show the progressive loading of three layers of articles 45 into carton 20, and the interleaving of the layer-divider panels 32 and 34 with the layers of articles; and the closing of carton 20. Glue flap 27*a* may be glued or otherwise secured in the position shown in FIG. 8. Additionally, glue flaps 27*b* and 27*c* are preferably positioned, during the closing, inside of side walls 24 and 25, respectively, to enable access to the top edges of the vent and strap panels so that they may be opened.

Parenthetically, the invention provides a carton for a microwave food package wherein, for instance, two layers of articles 45 such as food pieces having oppositely facing planar surfaces are so disposed with respect to microwave susceptor elements of the package that two oppositely disposed planar surfaces of each food piece are in snug contacting relation with microwave susceptor elements. This enables direct conductive heating by the microwave susceptors to effect, for example, crispening and possibly browning of outer portions of the food pieces when the package is heated within a microwave oven. The food pieces may, for example, be uniformly sized and shaped potato strips which have preferably been parfried prior to packaging. Such potato strips, whether parfried or not, are commonly and hereinafter referred to as french fries albeit they are not deep fat fried to a doneness state as stated above.

Figure 9:
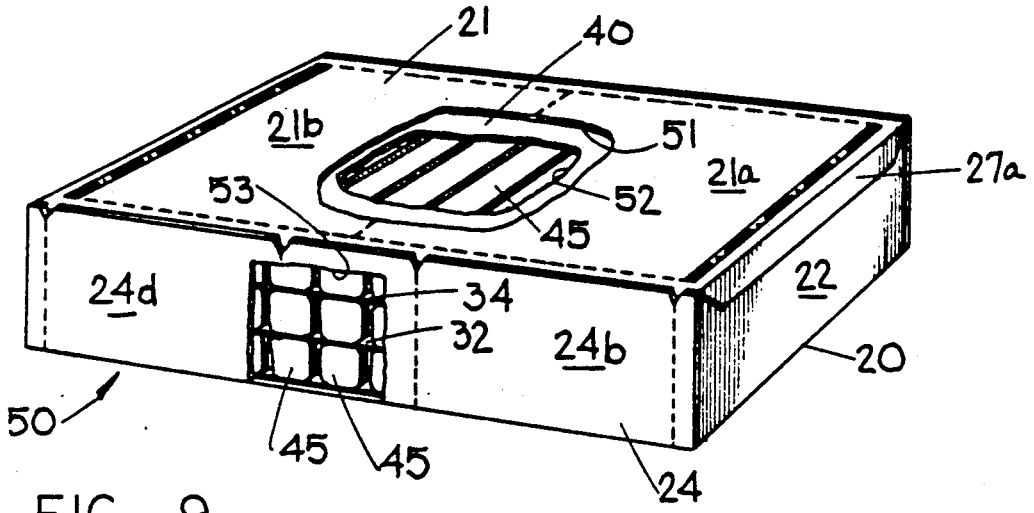
FIG. 9 is a perspective, partially torn away view of a microwave food package comprising a filled and closed carton of the configuration shown in FIG. 1.

FIG. 9, is a perspective view of an exemplary package 50 comprising carton 20, and three (3) layers of articles such as square cut, elongate food pieces 45 having planar top and bottom surfaces, and uniform thicknesses. As shown, carton 20 is closed. A portion of the layer 40 of microwave susceptor material disposed on the underside of top wall 21 is visible through a hole torn in the top wall 21 of carton 20 which hole is defined by edge 51; and some food pieces 45 are visible through a hole torn in the layer 40 of microwave susceptor material, which hole is defined by edge 52. Additionally, through a hole torn in side wall 24 which hole is defined by edge 53, the two integral layer-divider panels 32 and 34 are visible.

Figure 10:
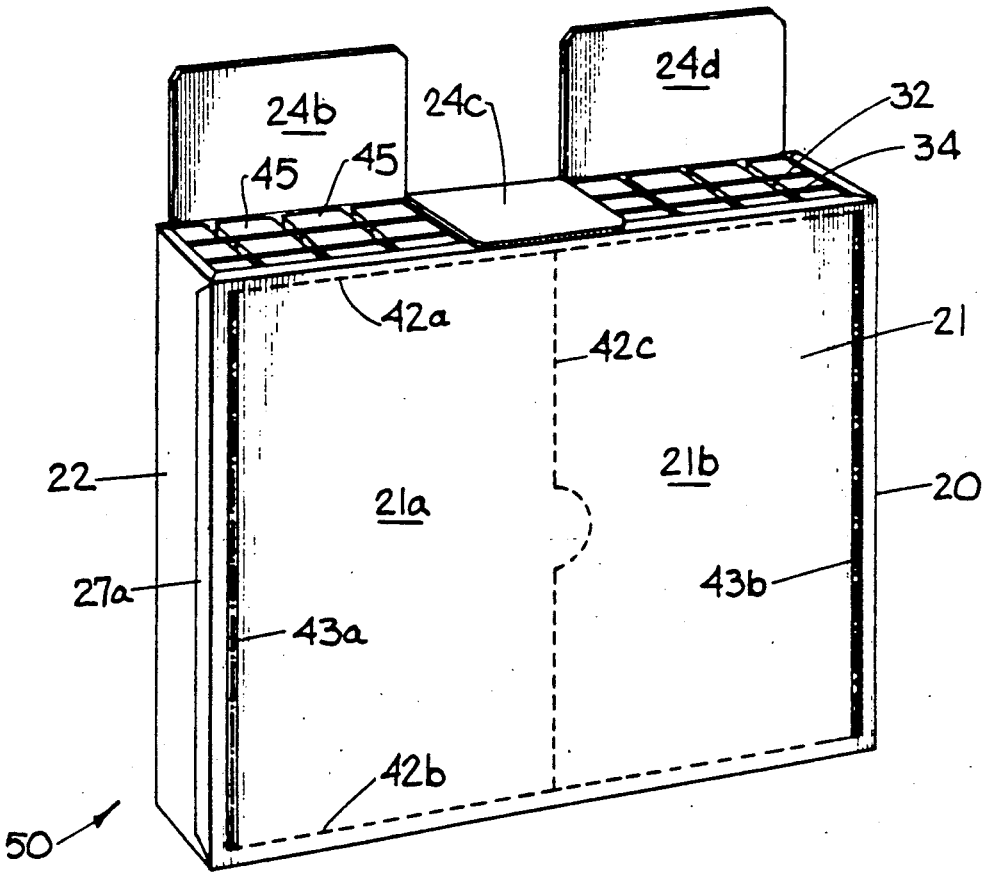
FIG. 10 is a perspective view of the package of FIG. 9 with two vent flaps of the carton in their open positions, and with the package in its preferred disposition for placement in a microwave oven.

Referring now to FIG. 10, package 50 is oriented with its top wall 21 facing forward, and its side flap 24 at the top of the figure. The configuration and orientation shown in FIG. 10 is the preferred configuration and orientation for placement of package 50 in a microwave oven for heating/cooking of the food pieces 45. Vent panels 24*b* and 24*d* are open, and extend upward to enable the escape of volatiles during microwave heating. Strap panel 24*c* is in its closed position to strap edge portions of the top wall 21 and the bottom wall 26 of carton 20 together. Thus, strap panel 24*c* functions to maintain a snug contacting relation between the microwave susceptor elements of the carton and the adjacent surfaces of the food pieces 45 during microwave heating/cooking. As stated above, this snug contacting relation between microwave susceptor panels and adjacent surfaces of food pieces is to effect or ensure crispening and possibly browning of the outer portions of the food pieces.

Figure 11:
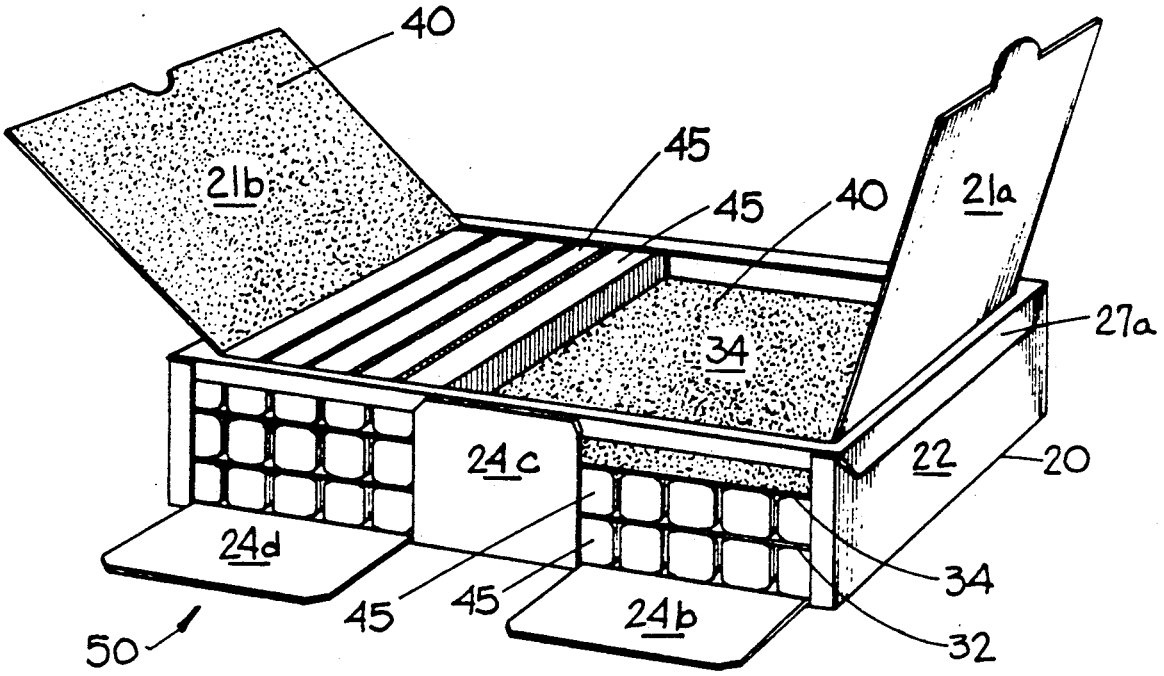
FIG. 11 is a perspective view of the package of FIG. 10 after it has been repositioned, and its top wall portions opened to provide through-the-top eating access to the contents of the package.

Package 50, FIGS. 9–11, inclusive, comprises dual or duplex means for being opened to provide access to remove the food pieces 45 therefrom. Such access is referred to as eating access. One mode of eating access may be provided by orienting package 50 as shown in FIG. 10, and opening the strap panel 24*c*. This is referred to as side access or end-on eating access.

A second mode of eating access for the contents of package 50 is provided by carton 20, shown in perspective in FIG. 11, and referred to as top or layer-by-layer eating access. In FIG. 11, panels 21*a* and 21*b* have been hinged opened, the opening being enabled by rupturing the lines of weakening 42*a* through 42*c*, and hinging them about score lines 43*a* and 43*b*, respectively. Some of the food pieces 45 comprising the top layer have been removed as evidenced by a visible portion of upper layer-divider panel 34. That panel 32 will, of course, be torn out or folded out or otherwise opened or removed upon exhaustion of the top layer of food, to provide access to the second layer, and so forth. Alternatively, panel 32 may be provided with lines of weakening and score lines (not shown) as in top wall 21 to enable opening it like top panel 21 as described above. Such an opening feature for layer-divider panels is shown in the alternate carton embodiment 120 described below, and shown in FIGS. 12 through 14, inclusive.

ALTERNATE EMBODIMENT

Figure 12:
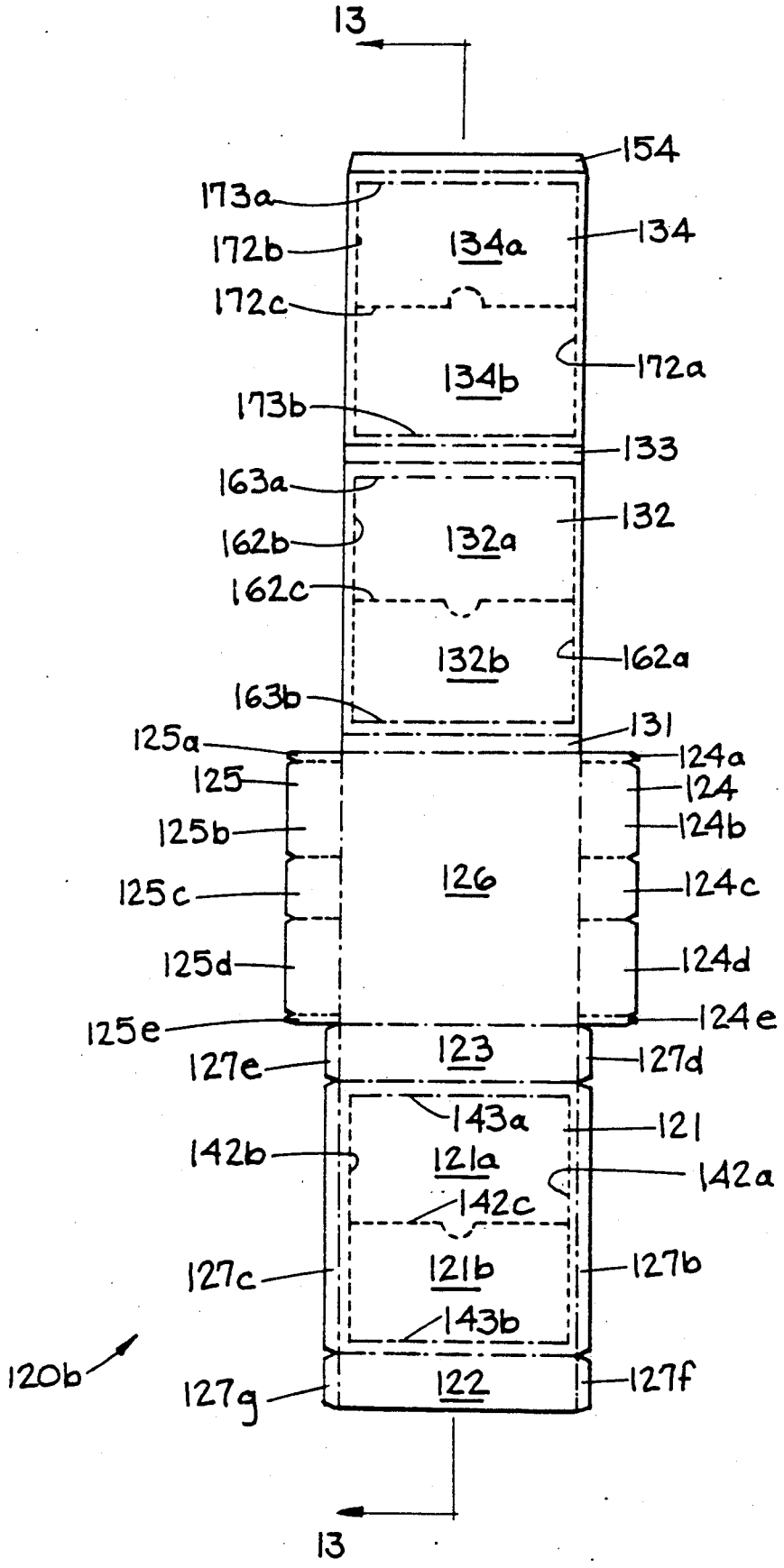
FIG. 12 is a plan view of an alternate embodiment, one piece carton blank which may, after being provided with a layer of microwave susceptor material on its top and bottom walls, and its two integral layer-divider panels, be erected to form a carton having two integral, intermediate-level microwave susceptor panels.

Carton blank 120*b*, FIG. 12, is, briefly, a second alternate carton blank having two integral layer-divider panels. Carton blank 120*b* is preferably provided with microwave susceptor materials, not shown, on its top and bottom walls as described above in conjunction with carton 20, and its integral layer-divider panels 132 and 134 in the same manner prior to its being erected to have the cross sectional configuration shown in FIG. 13.

Referring back to FIG. 12, carton blank 120*b* comprises top wall 121, front wall 122, back wall 123, side walls 124 and 125, bottom wall 126, glue flaps 127*b* through 127*g*, and a concatenated series of panels which include first spacer panel 131, a lower integral layer-divider panel 132, a second spacer panel 133, an upper integral layer-divider panel 134, and a distal flap panel 154. Element by element, and feature by feature, the elements and features of carton blank 120*b* which correspond to those of carton blank 20*b* are identically designated but for the designators for blank 120*b* being in the 100 series, whereas the designators of blank 20*b* are all two digit numbers. Accordingly, carton blank 120, FIGS. 13 and 14, which is formed by erecting blank 120*b* is vented, and opened in the general manner described above with respect to carton 20. However, the integral layer divider panels 132 and 134 of carton blank 120*b* are subdivided by lines of weakening and score lines as indicated so that they can be hinged open to provide layer-by-layer eating access to the lower layers of articles packaged therein. More specifically, the lower integral layer-divider panel 132 is subdivided into panels 132*a* and 132*b* by lines of weakening 162*a*–162*c*, and hinge score lines 163*a* and 163*b*; and the upper integral layer-divider panel 134 is subdivided into panels 134*a* and 134*b* by lines of weakening 172*a*–172*c*, and hinge score lines 173*a* and 173*b*. Of course, such layer-by-layer eating access means can also be incorporated in carton blank 20*b* as noted above albeit not so indicated in the figures.

Figure 13:
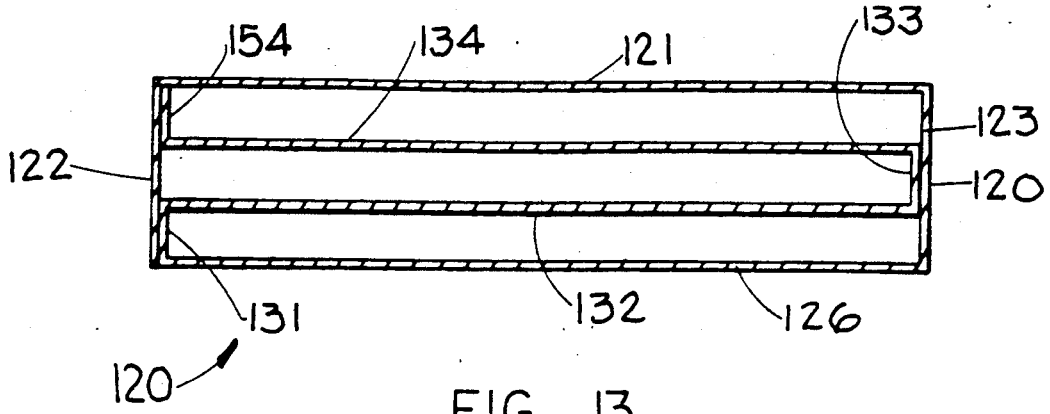
FIG. 13 is a cross sectional view of a carton formed by erecting a carton blank of the configuration shown in FIG. 12.

FIG. 13 is a cross sectional view of carton 120 taken along a section line corresponding to section line 13—13, FIG. 12. Carton 120 is formed by erecting carton blank 120*b*, FIG. 12, so that the panels and walls are positioned as shown in FIG. 13. Surface portions of panels 131, 133, and 154 which face portions of walls 122 and 123 may be adhesively bonded together albeit it is not intended to thereby limit the scope of the present invention. Carton 120 is loaded with 3 layers of articles 45, and closed to form a package 150, FIG. 14.

Figure 14:
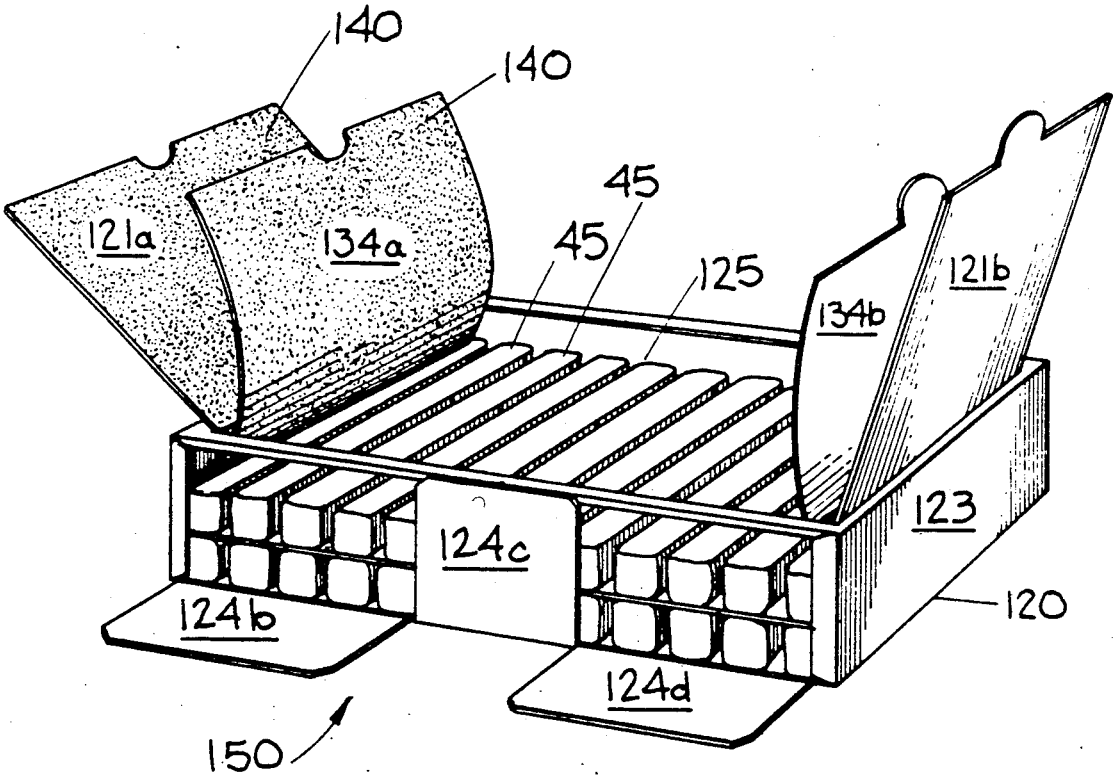
FIG. 14 is a perspective view of an opened package comprising a carton blank of the configuration shown in FIG. 12; and with the top layer of food pieces removed, and portions of the top intermediate-elevation susceptor panel folded back to provide top access to the intermediate layer of food pieces.

Package 150, FIG. 14, is shown after being opened by hinging back top panels 121*a* and 121*b*; and after having the top layer of articles removed, and providing access to the second layer of articles 45 by hinging back panel portions 134*a* and 134*b* of the upper integral layer-divider panel 134 as shown. Additionally, vent panel portions 124*b* and 124*d* are shown in their open positions: the positions they would have been in to enable venting of the package during microwave heating as described above in conjunction with the other embodiments of the invention.

Layers of microwave susceptor material which are visible in FIG. 14 are stippled and designated 140, but some of the layers of microwave susceptor are not visible in FIG. 14. Suffice it to say, as stated above, carton 120 does comprise sufficient microwave susceptor materials on its walls and panels that each article 45 disposed therein is snugly sandwiched between two microwave susceptor bearing walls and/or panels to provide the heating and crispening of each article 45 as described above.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A microwave carton formed from a one piece blank comprising a top panel, a bottom panel, and two layer-divider panels, said carton being sized to accommodate three layers of food pieces, said carton further comprising means for being erected, filled with three layers of food pieces, and closed with one of said layer-divider panels disposed between each two adjacent layers of said food pieces, and microwave susceptor means disposed on each said layer-divider panel and on said top panel and said bottom panel such that said microwave susceptor means is located in contacting relation with the upper and lower surfaces of each of said food pieces in each layer.

2. The microwave carton of claim 1 further comprising means for being substantially sealed after being filled, and means for venting to enable volatiles from said food pieces to escape during microwave heating.

3. The microwave carton of claim 1 further comprising duplex means for enabling access to remove said food pieces through at least two wall panels of said carton.

4. The microwave carton of claim 1 wherein said top panel comprises means for enabling consumer access to the top layer of said food pieces, and said layer divider panels comprise means for enabling through-the-top consumer access to the intermediate layer and the bottom layer of said food pieces.

5. The microwave carton of claim 4 wherein said means for enabling consumer access comprises lines of weakening which may be ruptured by a consumer to enable folding back portions of said top panel and said layer divider panels.

* * * * *